US010135142B2

(12) United States Patent
O'Brien et al.

(10) Patent No.: US 10,135,142 B2
(45) Date of Patent: Nov. 20, 2018

(54) ELECTRICALLY TUNED, MEANDERED, INVERTED L ANTENNA

(71) Applicant: BAE SYSTEMS INFORMATION AND ELECTRONIC SYSTEMS INTEGRATION INC., Nashua, NH (US)

(72) Inventors: Michael J. O'Brien, Nashua, NH (US); Ryan C. Lagoy, Leominster, MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 38 days.

(21) Appl. No.: 15/275,669

(22) Filed: Sep. 26, 2016

(65) Prior Publication Data

US 2018/0090842 A1 Mar. 29, 2018

(51) Int. Cl.

| | |
|---|---|
| ***H01Q 9/00*** | (2006.01) |
| ***H01Q 9/04*** | (2006.01) |
| ***H01Q 1/36*** | (2006.01) |
| ***H01Q 3/24*** | (2006.01) |
| ***H01Q 1/48*** | (2006.01) |
| ***H01Q 9/14*** | (2006.01) |

(52) U.S. Cl.

CPC ..... *H01Q 9/0442* (2013.01); *H01Q 1/36* (2013.01); *H01Q 1/48* (2013.01); *H01Q 9/0414* (2013.01); *H01Q 9/145* (2013.01)

(58) Field of Classification Search

CPC ..... H01Q 9/0442; H01Q 9/42; H01Q 11/14; H01Q 1/48; H01Q 9/0421

See application file for complete search history.

(56) References Cited

U.S. PATENT DOCUMENTS

| | | | | |
|---|---|---|---|---|
| 3,904,994 | A | 9/1975 | Bates et al. | |
| 5,790,080 | A | 8/1998 | Apostolos | |
| 6,492,953 | B2 | 12/2002 | Apostolos | |
| 9,147,936 | B1 * | 9/2015 | Apostolos | H01Q 9/285 |
| 2004/0080462 | A1 * | 4/2004 | Apostolos | H01Q 7/005 343/741 |
| 2004/0227683 | A1 * | 11/2004 | Caimi | H01Q 1/36 343/742 |
| 2005/0024281 | A1 | 2/2005 | Apostolos | |

OTHER PUBLICATIONS

International Search Report corresponding to PCT/US2017/052245 dated Jan. 11, 2018.

Written Opinion corresponding to PCT/US2017/052245 dated Jan. 11, 2018.

* cited by examiner

*Primary Examiner* — Dameon E Levi
*Assistant Examiner* — Ricardo Magallanes
(74) *Attorney, Agent, or Firm* — Davis & Bujold, PLLC

(57) ABSTRACT

The system and method for a tunable, slow-wave meander line antenna having a plurality of coplanar alternating high and low impedance traces. The tunable inverted L meander line antenna being suitable for space-constrained uses. Electronic switches, including solid state switches being used to tune the slow-wave meander-line inverted L antenna. Configurations of more than one antenna element providing polarization diversity, increased gain, and larger impedance bandwidths.

9 Claims, 10 Drawing Sheets

ELECTRICALLY TUNED, MEANDERED, INVERTED L ANTENNA

FIELD OF THE DISCLOSURE

The present disclosure relates to inverted L antennas and more particularly to electrically tuned, meandered, inverted L antennas.

BACKGROUND OF THE DISCLOSURE

A standard inverted L antenna is much like it sounds. The antenna runs along a vertical component that is connected at its base to a ground plane and a horizontal extension is connected to the top of the vertical component to form an inverted "L." Typically, the inverted L antenna is constructed as a transmitting and/or receiving antenna for use with short wave radios, and the like. While these traditional inverted L antennas may be obscured along a tree line or a building, they are still quite visible.

It is understood that antenna performance is dependent upon the relationship between the antenna length and the wavelengths of operation. Generally, an antenna's mode is labeled as a fraction of a wavelength.

More recent antenna developments include meander line antenna couplers, used with vertical conductors attached to a ground plane, where the vertical conductors are bridged by a horizontal conductor. See, for example, U.S. Pat. Nos. 5,790,080 and 6,492,953, Applicant's own work. There, meander line antenna couplers consist of slow wave, meander lines in the form of folded transmission lines mounted on a plate. By varying the distance between the line and the base plate, sections of varying impedance can be created to form the slow wave structure.

SWR, or standing wave ratio, is a measure of the impedance matching of loads to the characteristic impedance of a transmission line. Impedance mismatches result in standing waves along the transmission line. SWR is defined as the ratio of the partial standing wave's amplitude at an antinode (maximum) to the standing wave's amplitude at a node (minimum) along the line. SWR is usually thought of in terms of the maximum and minimum AC voltages along the transmission line, thus called the voltage standing wave ratio, or VSWR. EIRP is the amount of power that a theoretical isotropic antenna (i.e., an antenna that evenly distributes power in all directions) would emit to produce a peak power density observed in the direction of maximum antenna gain. EIRP takes into account the losses in transmission line and connectors and includes the gain of the antenna along with the RF power available. The EIRP is stated in terms of decibels over a reference power emitted by an isotropic radiator with equivalent signal strength in a given direction.

Some disadvantages of previous antennas include difficulty in achieving a low voltage standing wave ratio ("VSWR") thus reducing the efficiency of antenna and reducing its gain. For example, in a transmit system a reduced gain limits the antenna's ability to deliver the required effective isotropic radiated power (EIRP). Similarly, in a receive system a loss of gain lowers the receive sensitivity. Thus, in a transmit system the loss in gain due to mismatch losses associated with higher VSWR means greater RF power must be available to the antenna to achieve a desired EIRP. In a receiving system the loss in gain means the received signal level is weaker, even too weak to process.

The present disclosure provides antennas with improved gain with lower VSWR that deliver improved EIRP and/or receive sensitivity. In certain embodiments, the antennas are electronically tuned and are ideally suited for a space-constrained environment based, in part, on the co-planar relationship between the impedance sections.

SUMMARY OF THE DISCLOSURE

It has been recognized that there is a need for antennas that are electronically tuned and are ideally suited for a space-constrained environment.

One aspect of the present disclosure is a tunable, slow-wave antenna element comprising, a ground plane; a radiating element comprising a meander plane; one or more vertical height supports for supporting the radiating element a distance above the ground plane; a planar slow-wave meander line disposed on the meander plane, wherein the meander line has a physical length with a greater effective electrical length and comprises a plurality of alternating low impedance traces and high impedance traces; and one or more electronic switches configured to adjust the effective length of the planar meander line to tune a resonant frequency electronically.

One embodiment of the antenna element is wherein the electronic switches are solid state. One embodiment of the antenna element further comprises an element support configured to receive one or more antenna elements.

One embodiment of the antenna element has a VSWR of less than 3 to 1 at frequencies ranging from about 50 MHz to about 80 MHz.

Another aspect of the disclosure is a method of manufacturing a tunable bandwidth antenna that uses simple low cost printed circuit technology to produce a plurality of high impedance traces on the meander plane; a plurality of low impedance traces on the meander plane; a plurality of electronic switch mounting pads on the meander plane; and a plurality of bias circuits on the meander plane. Having all the tuning and bias electronics printed using circuit card material facilitates and reduces the production cost.

Another aspect of the disclosure is a method of tuning an antenna element comprising; providing a meander plane; providing one or more vertical height supports for supporting the meander plane a distance above a surface; providing a planar, slow-wave meander line disposed on the meander plane, wherein the meander line has a physical length with a greater effective electrical length and comprises a plurality of low impedance traces; and providing one or more electronic switches configured to adjust the effective length of the planar meander line to tune a resonant frequency electronically.

One embodiments of the method of tuning an antenna element is wherein adjusting the effective length of the planar meander line tunes the narrow instantaneous bandwidth antenna over a broader operating bandwidth. Another embodiment of the method of tuning an antenna element is wherein the electronic switches are solid state.

An embodiment of the method of tuning an antenna element is wherein the meander lines are fabricated using conventional printed circuit technology thus simplifying the manufacturing process and reducing the overall size and cost of the system. In some embodiments of the method of tuning an antenna element, the antenna has a VSWR of less than 3 to 1 at frequencies ranging from about 50 MHz to about 80 MHz.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

DETAILED DESCRIPTION OF THE DISCLOSURE

In certain embodiments of the present disclosure, the electrically tuned, meandered, inverted-L antenna is electrically small and capable of operating over a tuned bandwidth that is greater than 5 to 1. In some embodiments, the antenna is less than $1/10^{th}$ of a wavelength. In certain embodiments, the system further comprises a voltage standing wave ratio ("VSWR") that is less than 3:1 over a broad instantaneous bandwidth within the broad operating band. The dual element configuration presented in FIG. 2A was tuned over the operating frequency range of 30 MHz to 112 MHz. In the dual element configuration, the VSWR bandwidth achieved, as presented in 2C, is approximately 40 MHz, which is relatively broad when comparing other apertures of similar size.

Figure 1A:
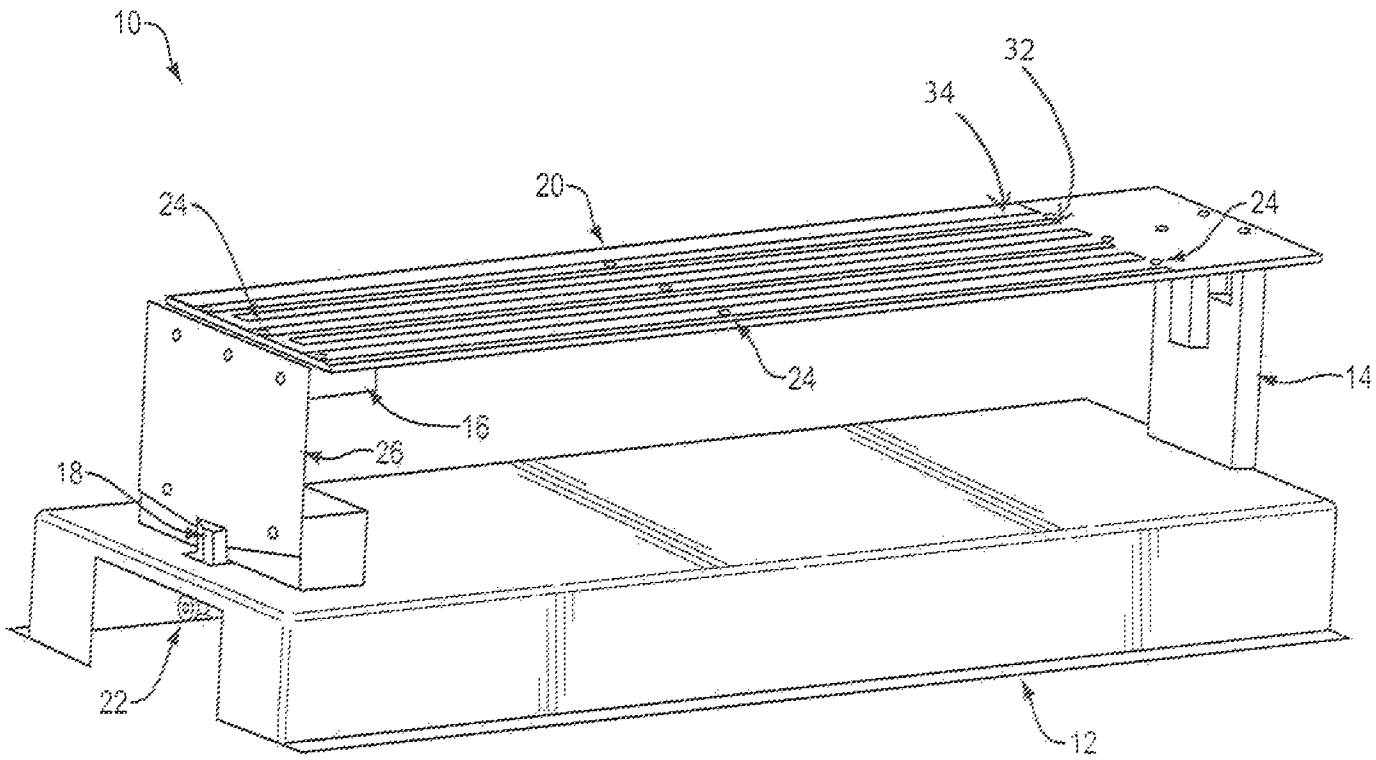
FIG. 1A shows one embodiment of a single inverted L meander line antenna element of the present disclosure.

FIG. 1A illustrates important features of a single element of the present disclosure. In certain embodiments, the antenna does not require an external impedance matching circuit to provide the desired VSWR. In some embodiments, the antenna has a coaxial line feed (18, 22) driving a tapered vertical arm. In certain embodiments, a capacitive gap couples energy from the vertical arm to the radiating element at higher frequencies while lower frequencies couple to the radiating element via an alternating high impedance/low impedance meander line to provide the impedance match at lower frequencies. In certain embodiments, high and low impedance sections are co-planar, with wider copper traces, as seen for example in FIGS. 1A-1D), producing lower characteristic impedance sections of the meander transmission line and narrower traces, as seen for example in FIGS. 1A-1D, producing higher impedance sections of the meander transmission line.

In certain embodiments, switches (24) allow the antenna to be tuned to resonate at different frequencies by changing the length of the meander transmission line that excites a radiating element. Some switches allow the electrically small antenna to be tuned dynamically, as desired, over a broader operating bandwidth. In certain embodiments, different switch positions are used along a meander leg. Switch positions are selected based on the particular application and performance objectives as will be discussed in more detail below.

Still referring to FIG. 1A, one embodiment of the inverted L meander line antenna element of the present disclosure is shown. More particularly, one embodiment of an element (10) is shown on an element support (12). The vertical support, or adjustable height support (14), provides the electrical connection between the coaxial feed point (18, 22) and the meander line that excites the radiating element. The vertical support is comprised of a conductive material, including, but not limited to a copper sheet, Roger's 6010 double sided printed circuit card stock, or the like. In certain embodiments, there is at least one adjustable height support (14). In certain embodiments, there is at least one adjustable gap support (16). The height of the support influences the input impedance for a given radiating element. The adjustable gap provides a parallel capacitive coupling between the vertical feed and the radiating element. At low frequencies, the capacitive coupling presents a high impedance in comparison to the impedance of the meander line feed structure. At high frequencies, the capacitive coupling presents lower impedance to the radiating element than that presented by the meander line. The result of the double paths is an increase in the bandwidth of the antenna. At higher frequencies, the radiating element is resonant and does not require the tuning properties afforded by the meander line feed. The high frequency range for the elements that are 32 inches in length is approximately 90 MHz where the length approximates a quarter of the free space wavelength and the low frequency range is below 90 MHz where the length is less than a quarter of the free space wavelength.

In certain embodiments, there is a tapered vertical arm (26). The taper section of the vertical support also influences the input impedance, providing a tapered transmission line to transfer the impedance of the radiating structure to the desired 50 Ohm termination for the coaxial feed. In some embodiments, there is a meander plane (20) having traces of varying widths.

In certain embodiments, the antenna element operates at lower frequencies than its physical length suggests. At lower frequencies the radiating element length is short in comparison to the wavelength and the radiation impedance has a significant reactive component. The switchable length of the mender line feed network provides a series reactance that approximately cancels the reactive, or imaginary, portion of the radiation impedance to provide a nearly real input impedance to the antenna feed port. Because the reactive portion on the radiation impedance is sufficiently small and the real part is equal to the source impedance for a transmitter, or the load impedance for a receiver, maximum power is transferred to the antenna for transmission or maximum power is transferred to the receiver in a receiving operation. In certain embodiments, the element has one or more electronic switches (24). In some embodiments, the electronic switches are located along the meander. Electronic switches enable dynamic tuning over a broader operating bandwidth.

Figure 1B:
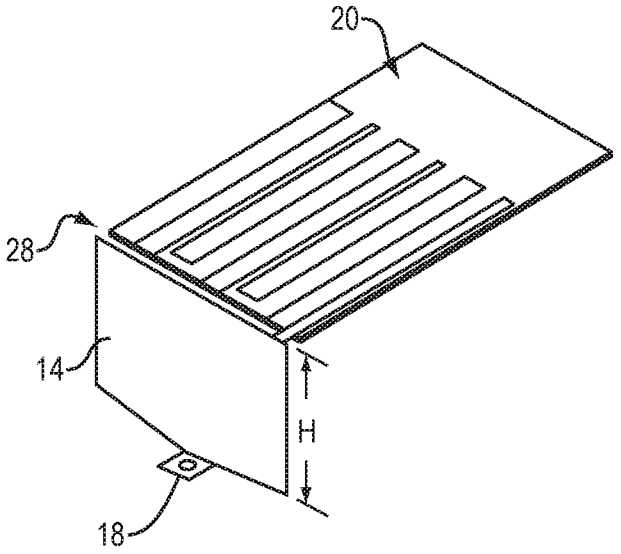
FIG. 1B shows an isometric view of one end of one embodiment of an inverted L meander line antenna element of the present disclosure.

Referring to FIG. 1B, an isometric view of one end of one embodiment of the inverted L meander line antenna element of the present disclosure is shown. More particularly, the vertical arm (14) is shown in relation to the meander plane (20) with a capacitive gap (28). In some embodiments, the height (H) of the vertical arm is about 6 inches, or 152 mm. The actual height for any application is a design variable. Other heights can be used depending on the desired operating frequency range and the available real estate.

Figure 1C:
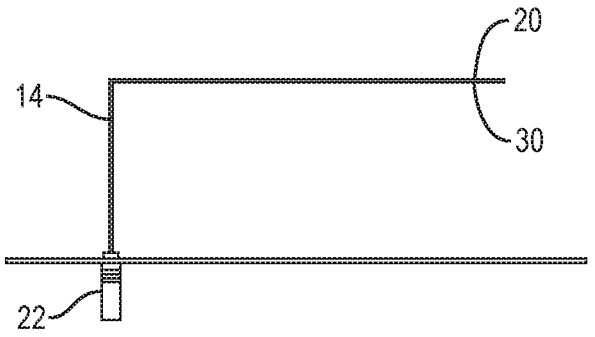
FIG. 1C shows a side view of one end of one embodiment of an inverted L meander line antenna element of the present disclosure.

Referring to FIG. 1C, a side view of one end of one embodiment of the inverted L meander line antenna element of the present disclosure is shown. There, the vertical arm (14) is shown in relation to the meander plane (20) and the coaxial feed (22). In certain embodiments, the meander reference "copper" plane (30) has a thickness of $t_{sub}$ of about 1.5 mm. The 1.5 mm thick substrate together with the width of the copper transmission lines provided the correct characteristic impedances. Other substrate thicknesses can be used as long as the width of the copper transmission lines is adjusted to produce the correct characteristic impedances.

Figure 1D:
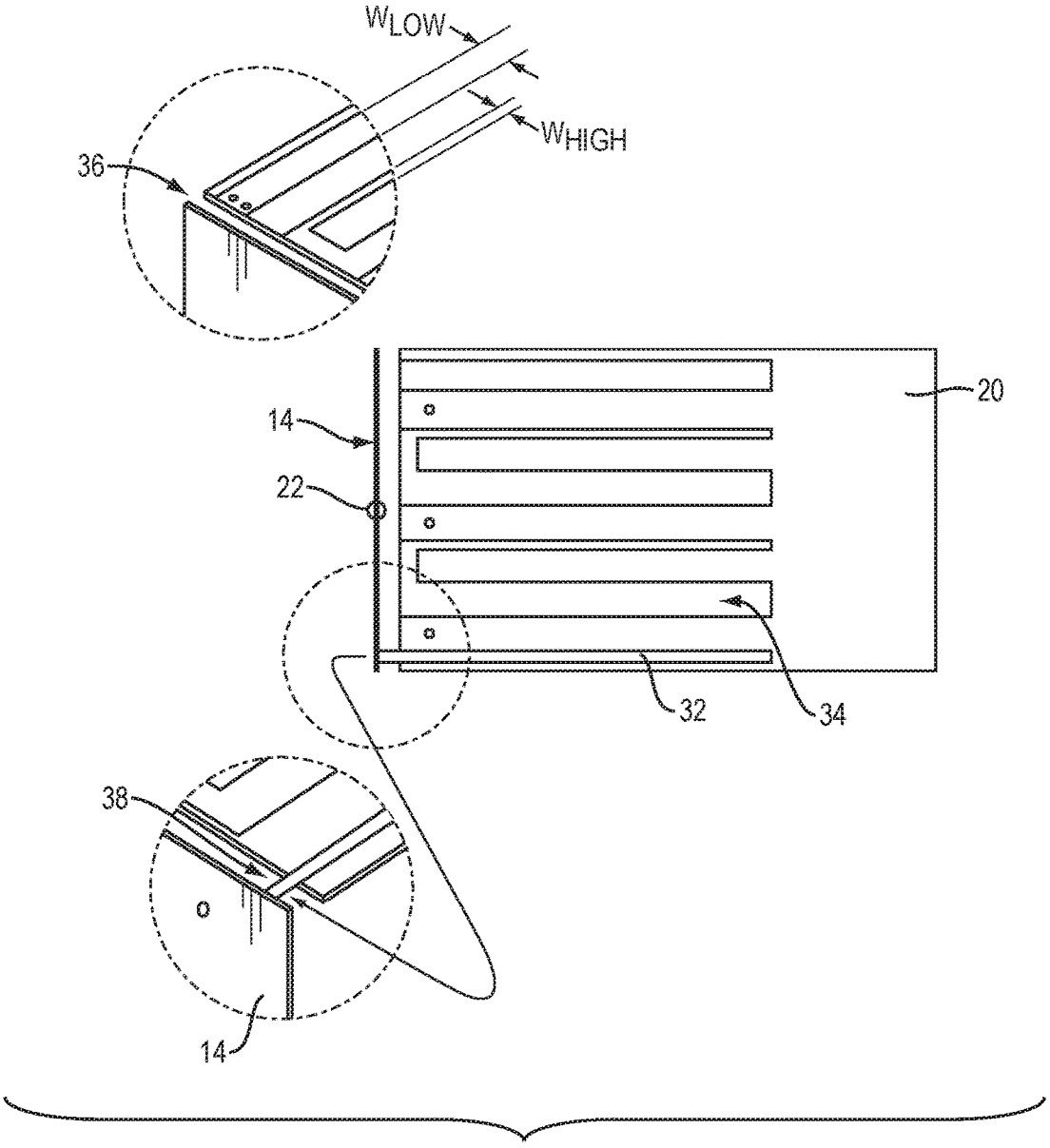
FIG. 1D shows a top view of one end of one embodiment of an inverted L meander line antenna element of the present disclosure as well as expanded views of the top corner and the underside corner of one end of one embodiment of an inverted L meander line antenna element of the present disclosure.

Referring to FIG. 1D, a top view of one end of one embodiment of the inverted L meander line antenna element of the present disclosure is shown as well as expanded views of the top corner and the underside of one corner of one embodiment of the inverted L meander line antenna element of the present disclosure. More specifically, the meander plane (20) is shown with meander traces (32, 34). In certain embodiments, the low impedance traces ($Z_{low}$) (34) have a width ($W_{low}$) of about 30 mm. In one embodiment, $W_{low}$ is 29.625 mm. In certain embodiments, the high impedance traces ($Z_{high}$) (32) have a width ($W_{high}$) of about 1 mm. In on embodiment, $W_{high}$ is 0.77 mm. In certain embodiments, $Z_{low}$ is about 20Ω. In one embodiment, $Z_{low}$ is 20.3Ω. In certain embodiments, $Z_{high}$ is about 128Ω. In one embodiment, $Z_{high}$ is 128.5Ω. In certain embodiments, the total impedance $Z_{total}$ given by the square root of $Z_{low}$ multiplied by $Z_{high}$ is about 50Ω, which is the characteristic impedance of the system. In one embodiment, $Z_{total}$ is 51Ω. In theory, the larger the difference between $Z_{low}$ and $Z_{high}$, the greater the effect of the slow wave phenomenon. However, a limiting factor is power handling of the high impedance trace, so $W_{low}$ is chosen to be wide enough such that it meets the requirements of the application.

Still referring to FIG. 1D, the meander line (32, 34) is connected to the copper reference plane (30) on the bottom as seen in (36). This connection terminates the high-low impedance structure to a copper reference plane. It is also possible to see that the vertical copper plate (14) is connected to the meander line (32) on the top as seen at (38). This direct connection between the vertical plate and the meander line feed allows for low frequency operation of the antenna.

In certain embodiments, the meander line is etched into a meander plane of an inverted L antenna of the present disclosure. In some embodiments, high-power handling switches are installed to adjust the length of the meander line, resulting in electrically tuning the antenna across a broad frequency range.

In certain embodiments, two inverted-L antennas are placed back-to-back and fed 180° out of phase to ensure that the resultant radiating pattern is perpendicular to the meandered top plate (not parallel to it). If available volume allows, more than one pair of dual elements can be included to form an array of dual elements. In certain embodiments, the VSWR is less than 3:1 within the instantaneous bandwidth as the antenna is tuned across the operational frequency band.

Figure 2A:
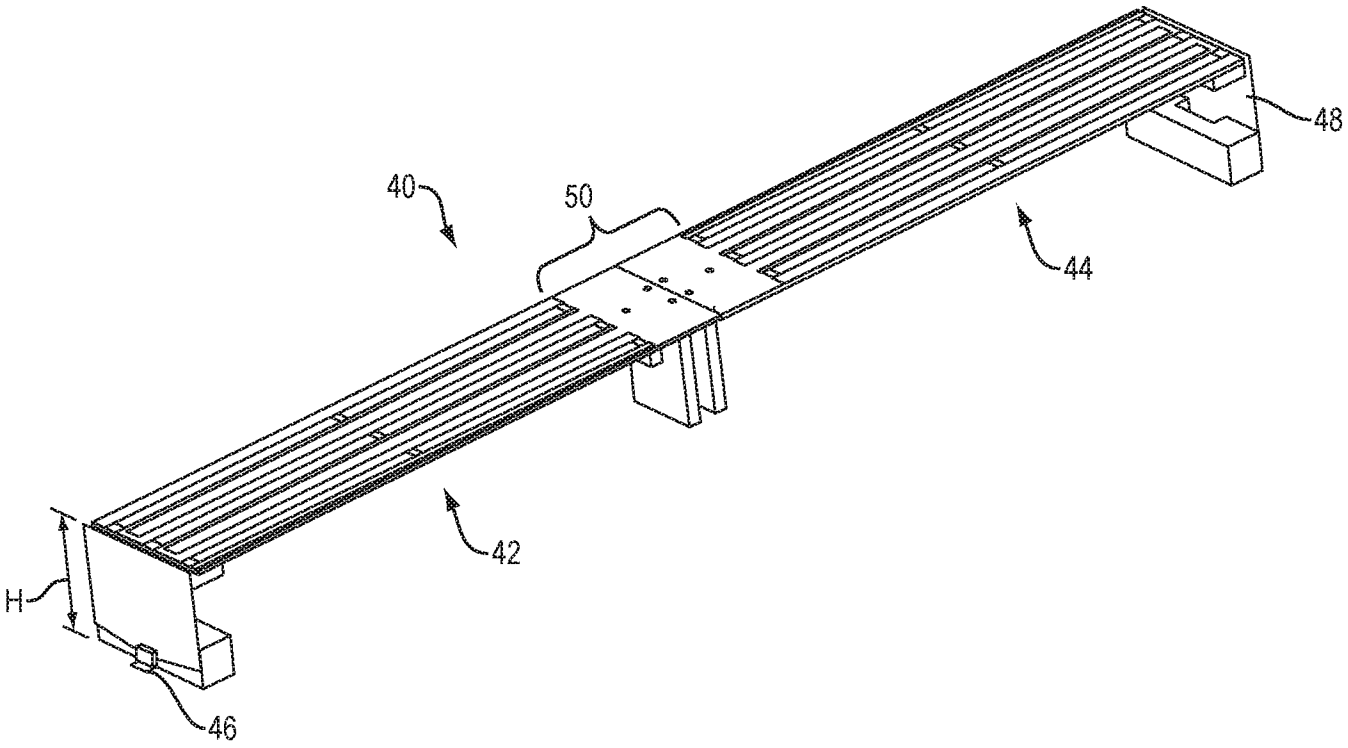
FIG. 2A shows one embodiment of an inverted L meander line antenna dual element configuration of the present disclosure.

FIG. 2A presents one embodiment of a dual element configuration of the present disclosure that improves polarization purity and improves VSWR. More particularly, in the dual element (40) configuration the second element (44) is fed 180° out of phase with first element (42) such that the current flows in the direction from feed 1 (46) to feed 2 (48). This allows for maximum radiation in a direction perpendicular to the ground plane and meander structure. The spacing between the two elements (50) is a design variable that allows the user to optimize mutual coupling effects between the two elements while providing desired VSWR and gain over the operating band of interest. In certain embodiments, more than one element has a positive effect on total performance. The combination of two feed ports in this configuration enables the pair of antenna elements to have a greater instantaneous bandwidth than either does separately by exploiting the inherent mutual coupling of the two. Exciting feed port 2 (48) 180° out of phase with feed port 1 (46) establishes the polarization of the dual pair, thereby increasing the gain in a direction perpendicular to the ground plane.

In certain embodiments, the inverted L meander line antenna of the present disclosure combines electronic tuning with a meander. In certain embodiments, the inverted L meander line antenna of the present disclosure embeds the meander in the antenna structure. In some embodiments, two elements are aligned such that they feed 180° out of phase. Feeding the two ports with 180° phase difference is often referred to as differential feed or push-pull feed.

Still referring to FIG. 2A, in certain embodiments the one or more elements are mounted to a base. In some embodiments, a mounted dual element configuration ranges from about 64 inches to about 96 inches in length, and from about 32 inches to about 48 inches from the center point along the length to the end. In certain embodiments, a mounted dual element configuration is about 38 inches wide. In certain embodiments, the dual element configuration is the same 6 inches high as the single element configuration, and mounted up about 4 inches high. Specific heights and lengths are application specific and are driven by the available real estate.

Figure 2B:
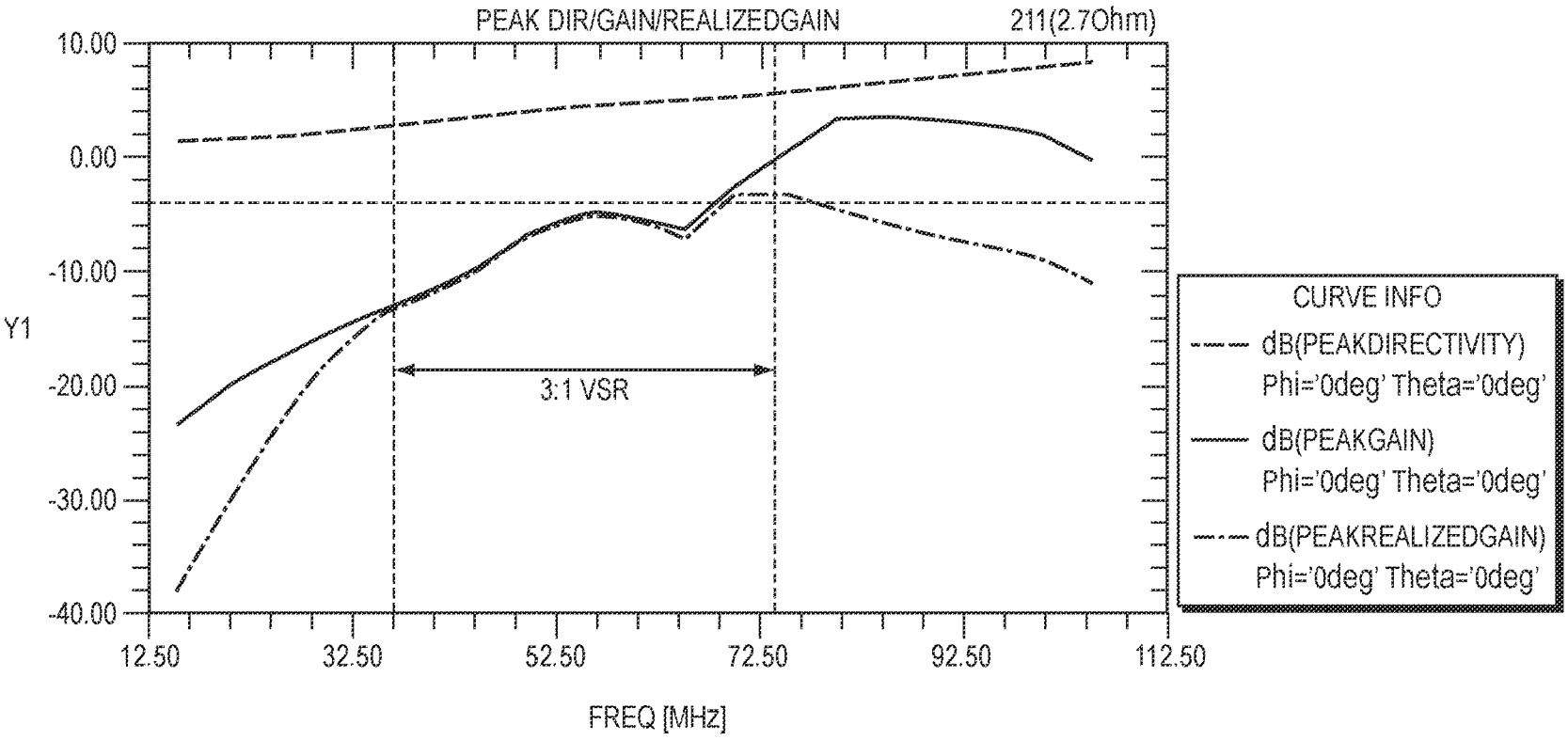
FIG. 2B compares three key antenna performance parameters in decibels relative to an isotropic antenna, namely peak directivity, peak gain and peak realized gain over a frequency range at bore-sight for one embodiment of the present disclosure.

Referring to FIG. 2B, three key antenna performance parameters in decibels are compared relative to an isotropic antenna, namely peak directivity, peak gain and peak realized gain over a frequency range for one embodiment of the present disclosure. Directivity quantifies the antenna's ability to concentrate the radiated energy in a given direction. The difference between gain and directivity quantifies how much power is dissipated in the antenna itself, such as in switching circuits used to tune the antenna, and not radiated while realized gain accounts for mismatch losses between the source and the antenna when transmitting or how much received power the antenna delivers to the receiver in a receive mode.

Still referring to FIG. 2B, because the antenna element is electrically small at low frequencies the peak directivity approximates that of an isotropic radiator, 0 dBi, and increases with increasing frequency. The peak gain is less than the directivity because of losses introduced by the transmission line and switching circuits. The small difference between the peak realized gain and the peak gain between 32 MHz and 72 MHz reflects the lower VSWR performance highlighted in FIG. 2C resulting in lower mismatch losses. The low VSWR from 33.4 MHz to 76.7 MHz demonstrates the instantaneous bandwidth achieved in this dual element configuration.

Figure 2C:
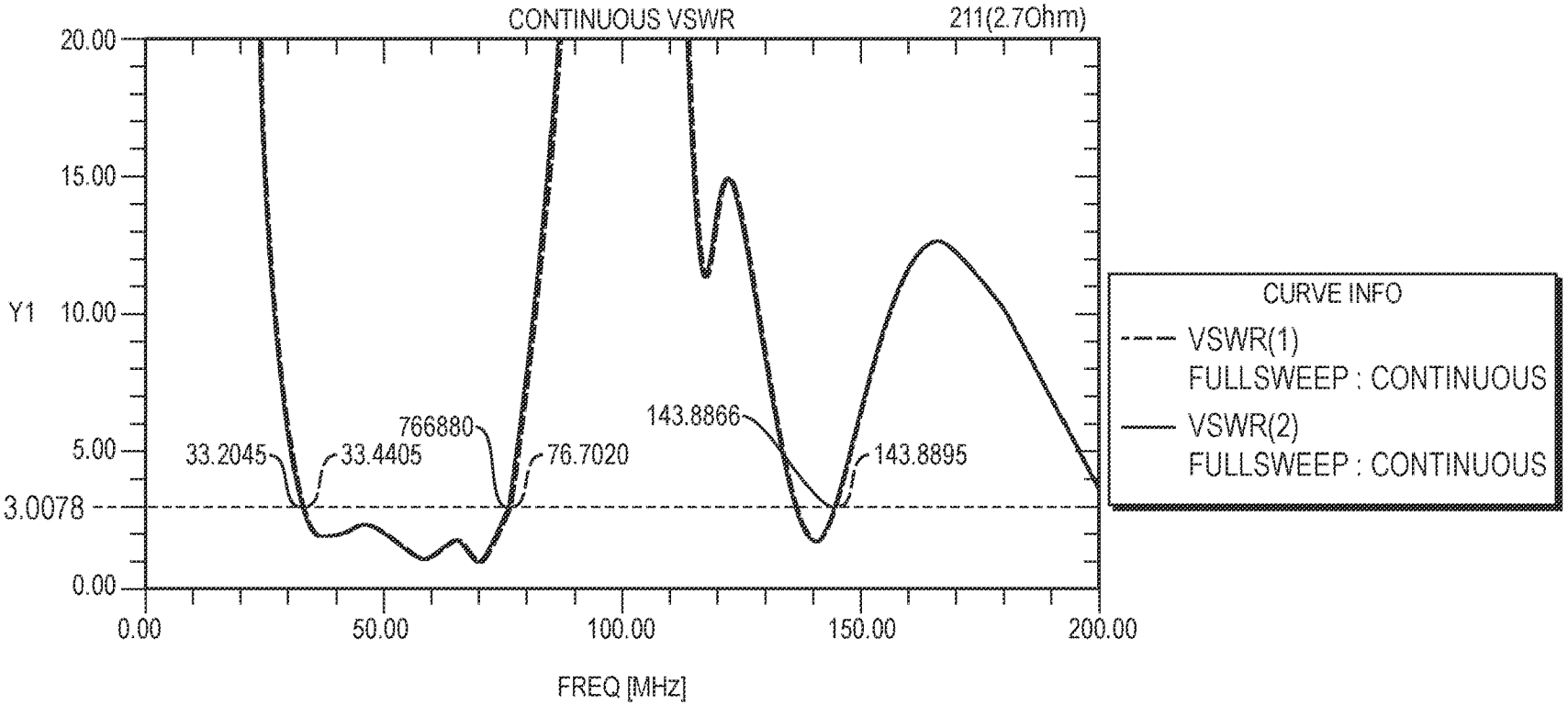
FIG. 2C shows the resultant VSWR for a dual element configuration with both elements set to the same tuning state.

Referring to FIG. 2C, the resultant VSWR for the dual element configuration with both elements set to the same tuning state is shown. The red curve is the predicted VSWR for the first element and the black curve is for the second element. The figure also includes the reference line of VSWR=3 to 1. The bandwidth for these elements where the VSWR is better than 3 to 1 is 43.3 MHz, with a center frequency of 55 MHz. The 43.3 MHz bandwidth is highlighted by markers at 76.7 MHz and 33.4 MHz.

Figure 2D:
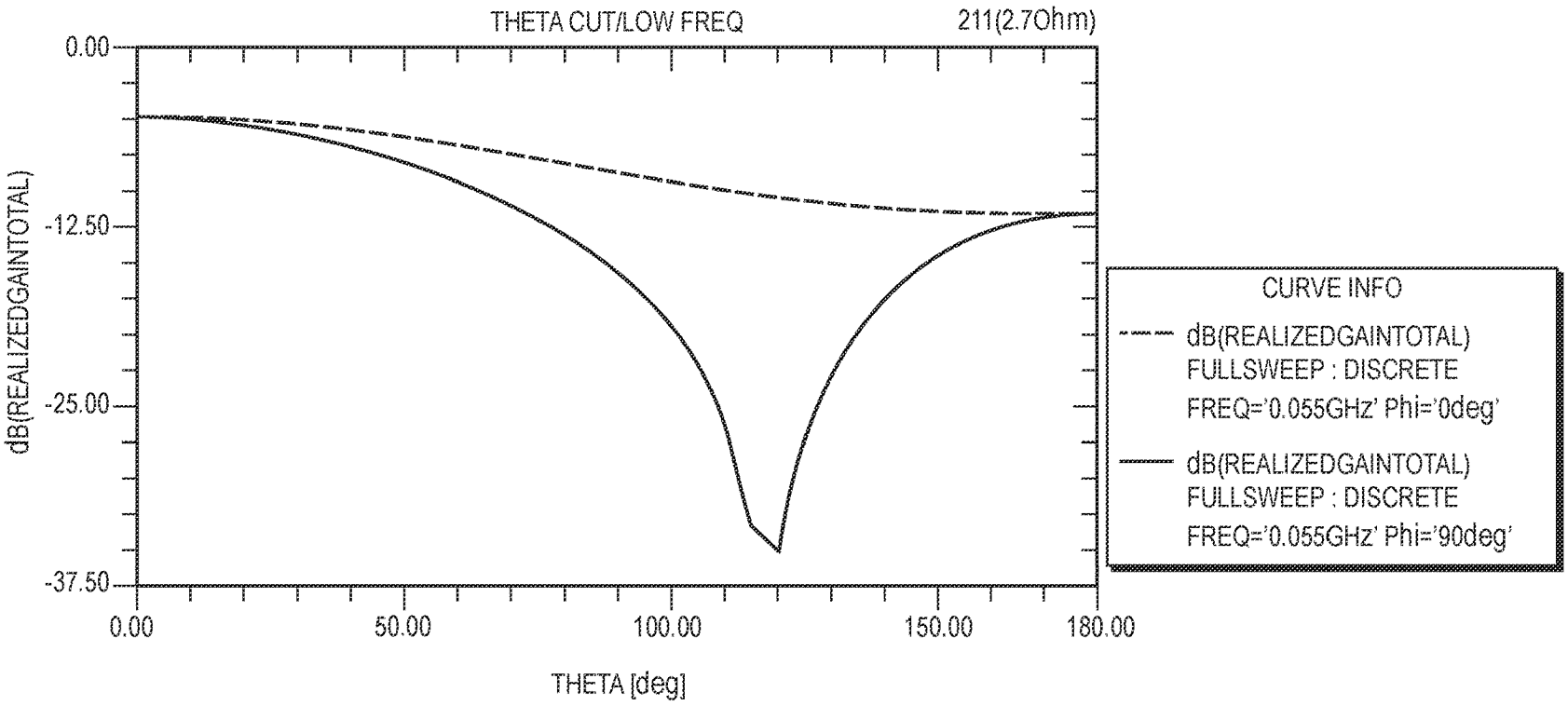
FIG. 2D shows the realized gain of the dual element configuration presented in FIG. 2A at the tuned center frequency of 55 MHz in two principal planes.

Referring to FIG. 2D, the realized gain of the dual element configuration presented in FIG. 2A at the tuned center frequency of 55 MHz in two principal planes is shown. As noted in the figure, the two planes are the phi=0 degree plane and the orthogonal phi=90 degree plane. The peak realized gain occurs at theta, =0 degrees and the null occurs in the phi=90 degree plane at theta approximately equal to 120 degrees. As noted, the gain patterns are for two principal planes, Phi=0 degrees and Phi=90 degrees for the switch state 211. The green curve shows the realized gain in the Phi=0 degree plane for Theta=0 degrees to 180 degrees while the blue curve shows the gain in the Phi=90 degree plane.

Figure 3A:
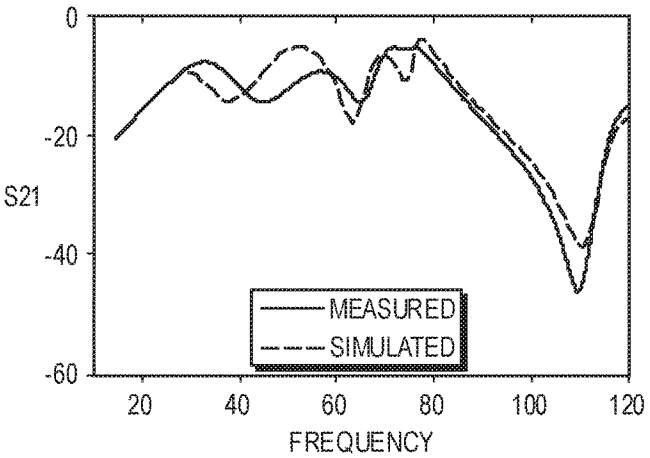
FIGS. 3A-3D shows plots of measured S21 parameters compared with predicted S21 parameters for embodiments of dual element inverted L meander line antennas of the present disclosure.
Figure 3B:
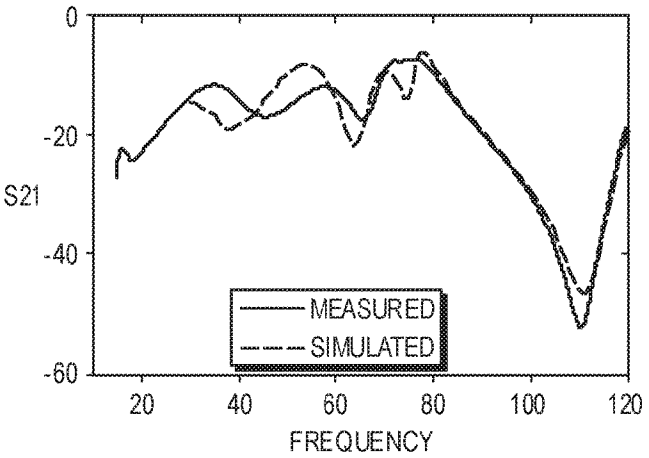
Figure 3C:
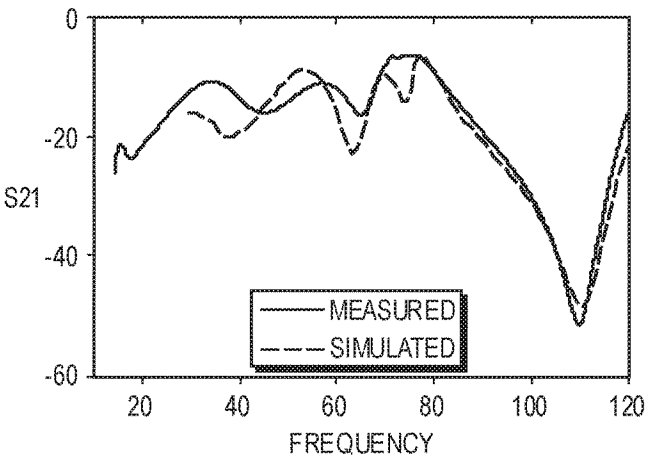
Figure 3D:
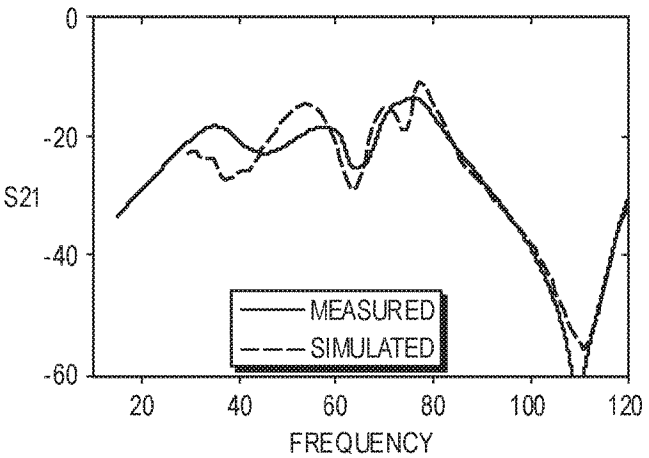
Figure 4A:
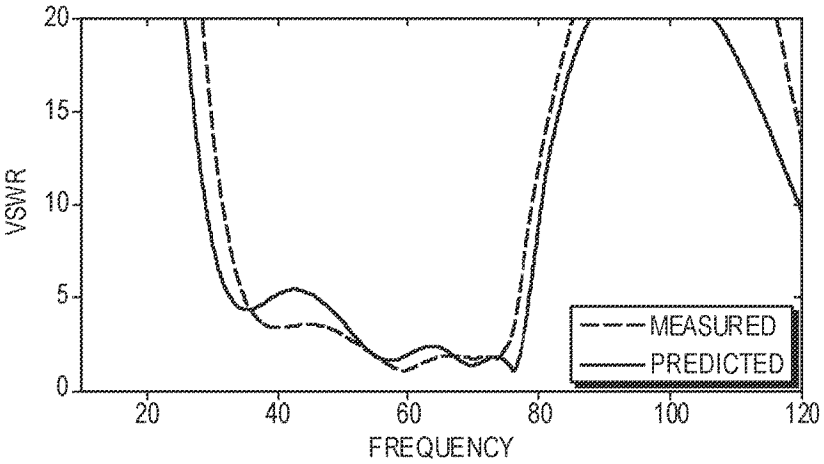
FIGS. 4A-4D shows plots of measured VSWR compared with predicted VSWR for embodiments of single inverted L meander line antennas of the present disclosure.
Figure 4B:
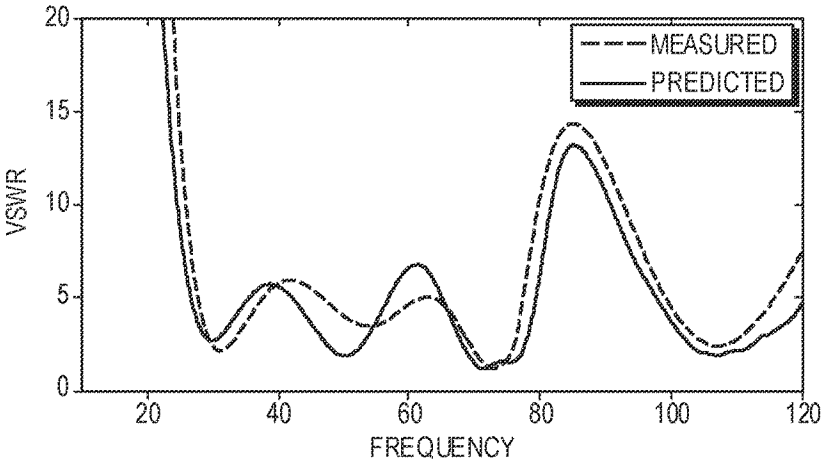
Figure 4C:
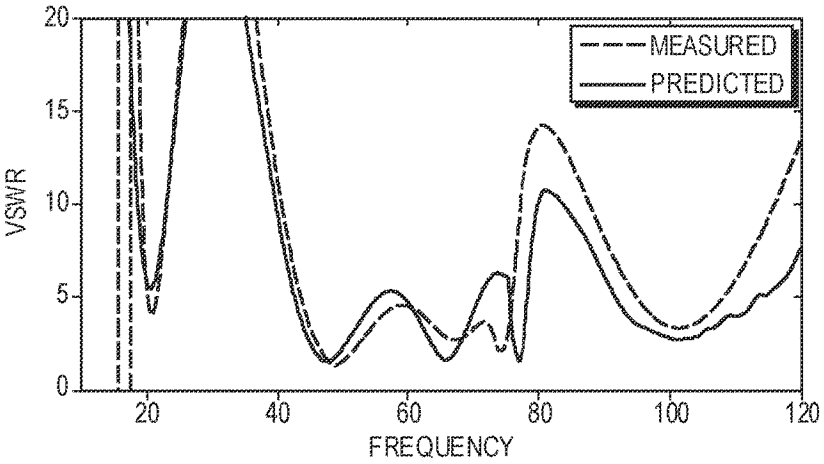
Figure 4D:
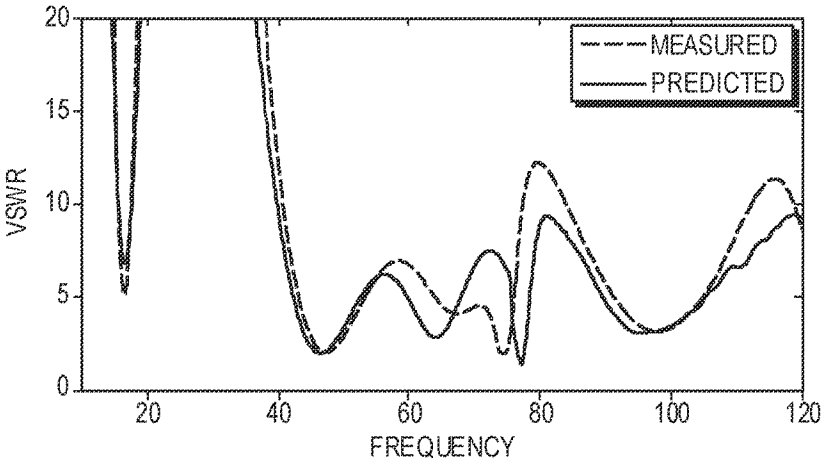

FIGS. 3A-3D shows mutual coupling between both elements in embodiments of a dual inverted L meander line antenna of the present disclosure. The results shown represent the mutual coupling between the two feed ports identified in FIG. 2 for a single common switch state, (e.g., 211). Each set of results is the mutual coupling for a fixed separation between the ends of the two antennas with FIG. 3A denoting the closest distance between the two, while FIG. 3D illustrates the coupling at the greatest distance measured.

Still referring to FIGS. 3A-3D, four different spacing values were demonstrated in a dual element embodiment of the present disclosure. The letter designations noted in FIG. 3 are representative. A indicates a 1 inch separation, B a 2 inch separation C a 3 inch separation and D a 4 inch separation. In certain embodiments, the 180° phase difference in the feed reinforces the radiation along the element axis to enhance that linear polarization while reducing the total radiation with polarization normal to the element face. In certain embodiments, the dual element configuration allows the user to combine the power of two high power amplifiers spatially, for improved power combining efficiency when used as a transmitter. If two high power amplifiers (HPAs), were to be combined using traditional RF power combiners the insertion loss of the power combiner would reduce the power available to the antenna element to radiate. However, if the output of each HPA is connected directly to a radiating antenna element, the contribution of each amplifier adds in the radiated fields and thus is not subject to the power combiner insertion loss. The result is greater effective radiated power, ERP.

FIGS. 3A-3D demonstrates the mutual coupling, or S21, between element 1 and element 2 of one embodiment of the dual element configuration. Noteworthy here is that the mutual coupling between these two elements is better than −10 dB for frequencies below 125 MHz. An important feature associated with mutual coupling is the amount of power that is delivered to one port of a two port antenna that is dissipated in the second port rather than being radiated. For example, if the coupling is −10 dB then only one tenth of the power accepted by one port would be dissipated in the second port. If the coupling were as high as −3 dB then one half of the power accepted by the first port would be dissipated in the second port to decrease overall antenna efficiency. As with the VSWR comparisons above, the FIGS. 3A-#d plots include a reference, S21. That threshold reference is −10 dB. In certain embodiments, the measured S21, or mutual coupling, between both elements in the dual element configuration with a 211 switch state agrees favorably with values predicted by the High Frequency Structure Simulator (HFSS) model. There, the S21 was shown to be better than −10 dB for frequencies below 125 MHz.

In certain embodiments, an antenna element is about 32 inches in length. In certain embodiments, an antenna element is about 7.75 inches wide. In certain embodiments, an antenna element is about 6 inches high. Because the top horizontal, element containing both the meander line structure and the radiating element reside on the same 1.5 mm thick printed circuit card substrate their contribution to the height of the antenna is negligible. Other heights and lengths can be used depending on both the volume constraints given for an application and the desired operating frequency range since both are design parameters.

The small size of this antenna enables it to be used in applications that could not physically support a more traditional antenna. For example, a resonant dipole antenna operating at 100 MHz would be approximately 60 inches long. If that dipole were to operate over a ground plane the antenna would also be 30 inches above the ground plane. One embodiment of the Inverted-L meander line antenna, shown in FIG. 1 is only about 6 inches, or 1/10 of the height required for the resonant dipole and its length is only about 32 inches, which is approximately ½ that of the resonant dipole. Similarly, a resonant dipole at 60 MHz would be approximately 100 inches long and 50 inches above the ground plane while the same 32 inch by 6 inch Inverted-L antenna can be tuned from 100 MHz to 60 MHz.

In certain embodiments, different electrical switches can be used to connect the high and low impedance sections of the line. PIN diode switch circuits may be used in applications where the switches are required to pass high currents. MEMs and other electromechanical switches can be used when tuning latency is not a concern. Field effect transistor, FET, switches may be used in applications where it is not necessary for the switch to pass high currents. The number of and placement of the switches is driven by a particular desired application. The configurations demonstrated included three switch positions between each of the three pairs of high and low impedance transmission line sections. Other configurations are also possible to enable more fine tuning increments if needed. In certain embodiments, there is a controller module for remotely controlling the switches. The remote control tuning capability is desirable for some applications such operating the antenna while it is mounted on an unmanned air vehicle, (UAV.)

Figure 5:
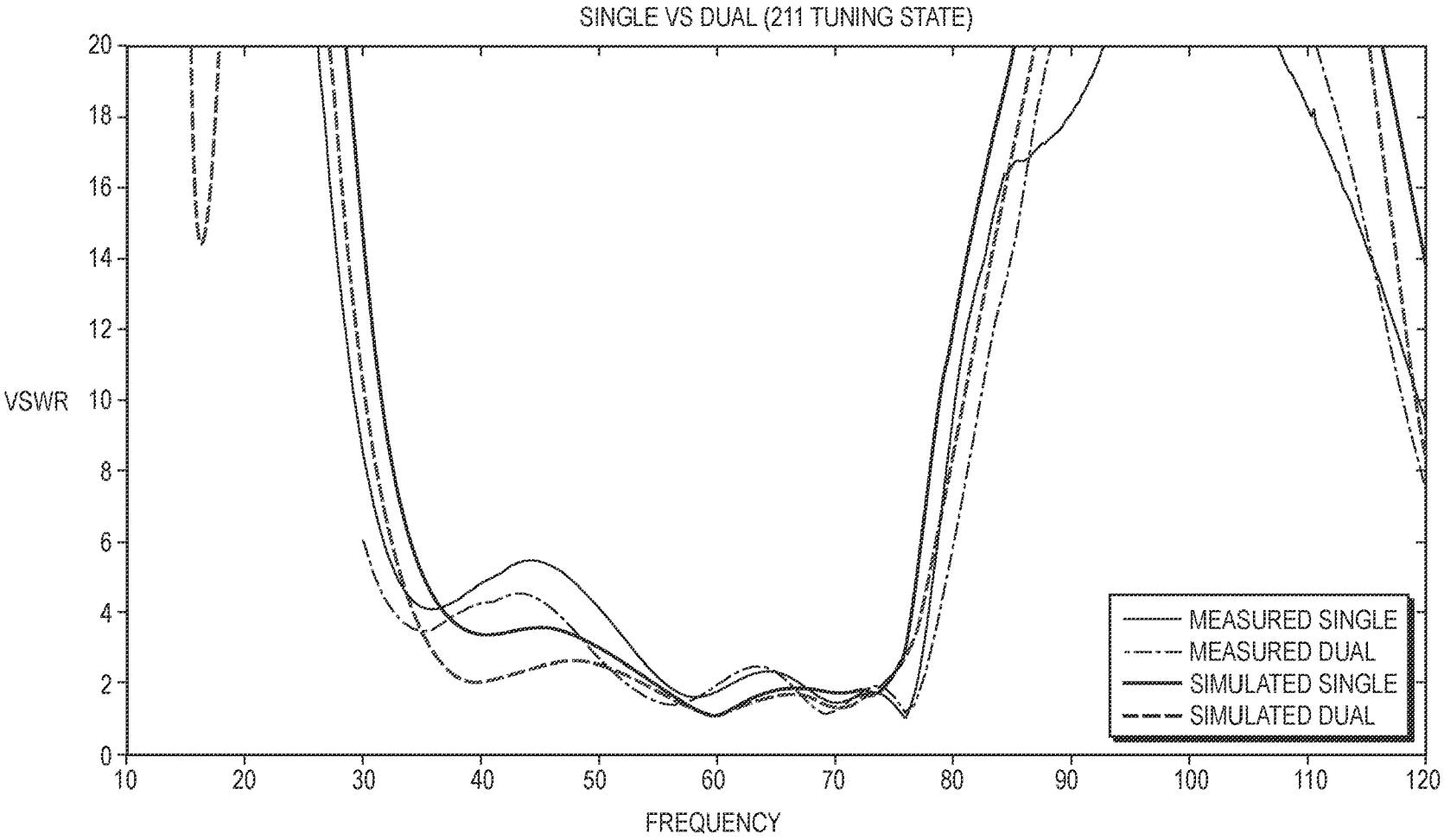
FIG. 5 shows a plot of measured VSWR compared with predicted VSWR for one embodiment of a dual inverted L meander line antenna and one embodiments of a single inverted L meander line antenna of the present disclosure.

The results presented in FIGS. 4 and 5 show the predicted and measured performance of certain embodiments of single and dual element antenna systems of the present disclosure. The graphs in FIG. 4 compare the measured and predicted VSWR response for one embodiment of a single element antenna with a middle switch of the first meander line pair and the first switch of both the second and the third meander line pairs closed. In certain embodiments this switch state is referred to as a 211 switch state.

FIG. 4 shows plots of measured VSWR compared with predicted VSWR for one embodiment of a single inverted L meander line antenna of the present disclosure. The four sets of results represent the VSWR for four different tuning states of the meander line to highlight the ability of the antenna to be tuned in real time. The blue line curves are the predicted VSWR values for each tuning state and the red line curves are the measured VSWR values. The tuning states are denoted by the three numbers at the top of each plot. In this embodiment, there are three switches between each of the pair of alternating high, low impedance transmission line sections in FIG. 1. One switch is at the beginning of each pair of lines, one in the middle position and one at the end. The number at the top of each graph denotes which of the switches is closed for that switch state. For example, switch state 321 of the lower left graph denotes the switch at the end of first pair, switch 3, of line is closed, the middle switch of the second pair, switch 2, is closed, and the switch at the beginning of the third pair, switch 1, is closed.

In certain embodiments, the predicted results were derived using HFSS. FIG. 4 and FIG. 5 also include a VSWR=3 to 1 curve for reference. Note the strong agreement between the predicted and measured VSWR. Also note that the VSWR is less than 3 to 1 from approximately 53 MHz to 78 MHz, an impedance bandwidth of 25 MHz. A VSWR of less than 3 to 1 is a common figure-of-merit for impedance bandwidth. Antennas with a VSWR=3 to 1 accept 75% of the power available to it. The 25 MHz impedance bandwidth is 38% at this frequency. For a typical thin half wavelength dipole antenna the impedance bandwidth is approximately 20%.

The graphs in FIG. 5 compare the measured and predicted VSWR response for one embodiment of the dual element configuration with the same switch states as used in FIG. 4. FIG. 5 shows plots of measured VSWR compared with predicted VSWR for one embodiment of one switch state dual inverted L meander line antenna of the present disclosure. FIG. 5 also includes both the predicted or simulated results and the measured results for the single inverted L meander line antenna in the same switch state for comparison. Both the simulated VSWR values and the measured VSWR values for the dual element embodiment are lower than those of the single element embodiment. Also important is the fact that the VSWR is lower over a wider bandwidth with the dual element configuration than it is with the single element embodiment. Note the slight increase in VSWR bandwidth in the dual element configuration. In certain embodiments, this configuration the VSWR is less than 3 to 1 from 51 MHz to 79 MHz.

In certain embodiments, electronic tuning is used for high-power radiated signals. In certain embodiments, the inverted L meander line antenna of the present disclosure provides improved overall performance in a space constrained environment. For example, unmanned air vehicles (UAVs) have limited volume in comparison to manned air vehicles and are limited in the size of external pods they can carry. Thus the size of antennas that can be used with these platforms is limited. The small, but tunable, antenna of the present disclosure enables these platforms to transmit higher power over a broader operating bandwidth.

Other potential applications for the system of the present disclosure include portable communication devices such as man carried radios. Small tunable antennas are also attractive in tagging and tracking devices where it is desired to not have the electronics observed easily.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. A tunable, slow-wave antenna element comprising:

a ground plane;

a radiating element comprising a meander plane;

one or more vertical height supports for supporting the radiating element a distance above the ground plane;

a planar slow-wave meander line disposed on the meander plane, wherein the meander line comprises a plurality of alternating low impedance traces and high impedance traces and the meander line forming a plurality of high and low impedance line pairs each having a first end, a second end, and a central portion; and one or more electronic switches located between each of the high and low impedance line pairs proximal to the first end, the second end, and the central portion of the high and low impedance line pairs, The one or more electronic switches being configured to adjust an effective length of the meander line by connecting one or more of the plurality of high and low impedance line pairs together to electronically tune a resonant frequency of the slow-wave antenna element.

2. The tunable, slow wave antenna element of claim 1, wherein the electronic switches are solid state.

3. The tunable, slow-wave antenna element of claim 1, further comprising an element support configured to receive one or more antenna elements wherein the one or more antenna elements are 180° out of phase with respect to an adjacent antenna element.

4. The tunable, slow-wave antenna element of claim 3, having a VSWR of less than 3 to 1 at frequencies ranging from about 50 MHz to about 80 MHz.

5. A method of manufacturing a tunable bandwidth antenna comprising: providing a meander plane having a first surface; providing at least one meander line on the first surface comprising a plurality of high and low impedance traces forming respective high and low impedance line pairs; producing a plurality of high impedance traces on the meander plane using printed circuit technology; producing a plurality of low impedance traces on the meander plane using printed circuit technology; and providing a plurality of electronic switches on the meander plane located between each high and low impedance line pair proximal to a first end, a second end, and a central portion of the high and low impedance line pair; wherein the one or more electronic switches are configured to adjust an effective length of the meander line by connecting the one or more high and low impedance line pairs together to electronically tune a resonant frequency of the tunable bandwidth antenna.

6. A method of tuning an antenna element comprising;

providing a meander plane;

providing one or more vertical height supports for supporting the meander plane a distance above a surface;

providing a planar, slow-wave meander line disposed on the meander plane, wherein the meander line comprises a plurality of low impedance traces and high impedance traces forming a plurality of high and low impedance line pairs; and providing one or more electronic switches located between each high and low impedance line pair proximal to a first end, a second end, and a central portion of the high and low impedance line pairs;

adjusting an effective length of the planar meander line by connecting the one or more high and low impedance line pairs together using the one or more electronic switches to electronically tune a resonant frequency of the antenna element.

7. The method of tuning an antenna element of claim 6, wherein the electronic switches are solid state.

8. The method of tuning an antenna element of claim 6, further comprising fabricating the meander lines using conventional printed circuit technology thus simplifying the manufacturing process and reducing the overall size and cost of the system.

9. The method of tuning an antenna element of claim 6, wherein the low impedance traces have a width of about 30 mm and the high impedance traces have a width of about 1 mm.

* * * * *